US008383306B2

(12) United States Patent
Pang et al.

(10) Patent No.: US 8,383,306 B2
(45) Date of Patent: Feb. 26, 2013

(54) ELECTROPHOTOGRAPHIC TONER AND METHOD OF PREPARING THE SAME

(75) Inventors: Kyeong Pang, Suwon-Si (KR); Jae-Hwan Kim, Seoul (KR); Jin-Mo Hong, Yongin-Si (KR); Su-Bum Park, Daegu Metropolitan (KR); Jeong-Hyun Lee, Suwon-Si (KR); Mi-Rim Cho, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 257 days.

(21) Appl. No.: 12/694,864

(22) Filed: Jan. 27, 2010

(65) Prior Publication Data

US 2011/0014560 A1 Jan. 20, 2011

(30) Foreign Application Priority Data

Jul. 14, 2009 (KR) ..... 10-2009-0064087

(51) Int. Cl.
*G03G 9/083* (2006.01)

(52) U.S. Cl. ..... 430/108.24; 430/96; 430/108.1; 430/108.7; 430/109.4

(58) Field of Classification Search ..... 430/96, 430/108.1, 108.24, 108.7, 109.4
See application file for complete search history.

(56) References Cited

U.S. PATENT DOCUMENTS

| | | | | |
|---|---|---|---|---|
| 5,686,218 | A | 11/1997 | Liebermann et al. | |
| 2006/0078815 | A1* | 4/2006 | Ito et al. | 430/109.4 |
| 2009/0111038 | A1* | 4/2009 | Shin et al. | 430/48 |

FOREIGN PATENT DOCUMENTS

KR 1020090072931 7/2009

OTHER PUBLICATIONS

European Search Report issued Oct. 6, 2010 in EP Application No. 10169036.0.

* cited by examiner

*Primary Examiner* — Peter Vajda
(74) *Attorney, Agent, or Firm* — Stanzione & Kim, LLP

(57) ABSTRACT

The present disclosure provides an electrographic toner and methods for preparing an electrographic toner. In particular, the present disclosure provides an electrophotographic toner comprising a latex, a colorant and a releasing agent. The electrophotographic toner may further comprise zinc (Zn), iron (Fe), and silicon (Si). The [Zn]/[Fe] ratio may be in the range of about $5.0\times10^{-2}$ to about 2.0. The [Si]/[Fe] ratio may be in the range of about $5.0\times10^{-4}$ to about $5.0\times10^{-2}$. [Zn], [Fe] and [Si] denote the intensities of Zn, Fe and Si, respectively, as measured by X-ray fluorescence spectrometry.

7 Claims, 2 Drawing Sheets

ELECTROPHOTOGRAPHIC TONER AND METHOD OF PREPARING THE SAME

CROSS-REFERENCE TO RELATED PATENT APPLICATION

This application claims the benefit of Korean Patent Application No. 10-2009-0064087, filed on Jul. 14, 2009, in the Korean Intellectual Property Office, the disclosure of which is hereby incorporated by reference in its entirety for all purposes.

TECHNICAL FIELD

The present disclosure generally relates to an electrophotographic toner and methods for preparing an electrographic toner.

BACKGROUND OF RELATED ART

Developers used to visualize electrostatic images or electrostatic latent images in electrographic or electrostatic processes can be classified into two-component developers and one-component developers. Two-component developers include toner and carrier particles whereas one-component developers consist exclusively of toner. One-component developers can be further classified into magnetic and nonmagnetic developers. In order to increase the fluidity of toner, nonmagnetic one-component developers often contain a fluidizing agent, such as colloidal silica. Typically, toner includes coloring particles obtained by dispersing a colorant, such as carbon black or other additives, in latex.

Methods for preparing toner include pulverization and polymerization processes. In the pulverization process, toner is obtained by melting and mixing a synthetic resin with a colorant, and optionally, other additives. After pulverizing, this mixture undergoes sorting until the particles of the desired size are obtained. In contrast, toner is obtained in the polymerization process by uniformly dissolving or dispersing various additives, such as a colorant, a polymerization initiator and, optionally, a cross-linking agent and an antistatic agent, in a polymerizable monomer. The polymerizable monomer composition is then dispersed in an aqueous dispersive medium, which includes a dispersion stabilizer, using an agitator to shape minute liquid droplet particles. The temperature of the composition is subsequently increased, and suspension polymerization is performed to obtain polymerized toner having coloring polymer particles of the desired size.

Conventionally, toner used in an imaging apparatus is obtained by pulverization. However, in pulverization it is difficult to precisely control the particle size, geometric size distribution, and the structure of toner, and thus, it is difficult to separately control the major characteristics of toner, such as charging characteristics, fixability, flowability, and preservation characteristics.

Recently, the use of polymerized toner has increased due to the simpler manufacturing process, which does not require sorting the particles, and due also to the ease of controlling the size of the particles. When toner is prepared through a polymerization process, polymerized toner having a desired particle size and particle size distribution can be obtained without pulverizing or sorting. In order to control the particle size and shape of toner to be uniform in a polymerization process, an agglomeration process for preparing agglomerated toner may be used through the use of a metal salt such as $MgCl_2$, and the like, or a polymeric material such as polyaluminum chloride (PAC).

By using a metal salt-based agglomerating agent it is possible to control the particle size and particle size distribution of toner or to reproducibly form a capsule structure with a shell. However, it is difficult to uniformly control the particle size and shape of toner. In other words, the particle size above a middle point of the particle size distribution of toner is highly controllable. However, smaller toner particles below the middle point of the particle size distribution tend to be more spherical than desired, and may cause problems in blade cleaning during electrophotographic processes. When PAC is used, the particle size and shape of toner can be uniformly controlled and toner has a stronger agglomerating force. However, the use of aluminum substances are restricted due to their effects on the environment. Thus, there remains a need in the art for new electrophotographic toner and methods for their preparation.

SUMMARY OF THE DISCLOSURE

The present disclosure provides an electrophotographic toner and methods for preparing the electrophotographic toner.

In one aspect, the present disclosure provides an electrophotographic toner including a latex, a colorant, and a releasing agent, wherein the electrophotographic toner includes zinc (Zn), iron (Fe) and silicon (Si), wherein the [Zn]/[Fe] ratio is in the range of about $5.0\times10^{-2}$ to about 2.0, and the [Si]/[Fe] ratio is in the range of about $5.0\times10^{-4}$ to about $5.0\times10^{-2}$, wherein [Zn], [Fe], and [Si] denote the intensities of Zn, Fe and Si, respectively, as measured by X-ray fluorescence spectrometry.

In another aspect, the present disclosure provides an electrophotographic toner that has a log G'(60) in the range of about $0.70\times10^{1}$ to about $0.90\times10^{1}$, and a $$\frac{\log G'(60) - \log G'(80)}{20}$$

value of about $1.0\times10^{-1}$ to about $2.0\times10^{-1}$, wherein G'(60) and G'(80) denote the storage moduli (Pa) of the electrophotographic toner at temperatures of 60° C. and 80° C., respectively, when the dynamic viscoelasticity of the electrophotographic toner is measured at an angular velocity of 6.28 rad/sec, a temperature ramp rate of 2.0° C./min, and an initial strain ratio of 0.3%.

In another aspect, the present disclosure provides an electrophotographic toner that has a $$\frac{\log G'(120) - \log G'(140)}{20}$$

value of about 0 to about $5.0\times10^{-2}$, wherein G'(120) and G'(140) denote the storage moduli (Pa) of the electrophotographic toner at temperatures of 120° C. and 140° C., respectively, when the dynamic viscoelasticity of the electrophotographic toner is measured at an angular velocity of 6.28 rad/sec, a temperature ramp rate of 1.0° C./min, and an initial strain ratio of 0.3%.

In another aspect, the present disclosure provides an electrophotographic toner wherein the amount of each of Si and Fe may be in the range of about 3 to about 30,000 ppm.

In another aspect, the present disclosure provides an electrophotographic toner wherein the latex may include at least two different polyester resins.

In another aspect, the present disclosure provides an electrophotographic toner wherein the average particle diameter of the electrophotographic toner is in the range of about 3 to about 9 μm.

In another aspect, the present disclosure provides an electrophotographic toner wherein the average circularity of the electrophotographic toner is in the range of about 0.940 to about 0.980.

In another aspect, the present disclosure provides an electrophotographic toner wherein the volume average particle size distribution coefficient (GSDv) of the electrophotographic toner is about 1.3 or less, and the number average particle size distribution coefficient (GSDp) of the electrophotographic toner is about 1.3 or less.

In another aspect, the present disclosure provides a method of preparing an electrophotographic toner, including the steps of: a) mixing primary latex particles, a colorant dispersion, and a releasing agent dispersion to provide a mixed solution; b) adding an agglomerating agent to the mixed solution to provide a primary agglomerated toner; and c) coating the primary agglomerated toner with secondary latex particles to provide a secondary agglomerated toner, wherein the secondary latex particles are prepared by polymerizing at least one polymerizable monomer, wherein the electrophotographic toner comprises zinc (Zn), iron (Fe), and silicon (Si), wherein the [Zn]/[Fe] ratio is in the range of about $5.0\times10^{-2}$ to about 2.0, and the [Si]/[Fe] ratio is in the range of about $5.0\times10^{-4}$ to about $5.0\times10^{-2}$, wherein [Zn], [Fe], and [Si] denote the intensities of Zn, Fe and Si, respectively, as measured by X-ray fluorescence spectrometry.

In another aspect, the present disclosure provides a method of preparing an electrophotographic toner wherein the primary latex particles and the secondary latex particles may be each prepared using a polyester resin alone or a mixture of a polyester resin and a polymer prepared by polymerizing at least one polymerizable monomer.

In another aspect, the present disclosure provides a method of preparing an electrophotographic toner wherein the primary latex particles and the secondary latex particles may be each prepared using at least two different polyester resins.

In another aspect, the present disclosure provides a method of preparing an electrophotographic toner further including coating the secondary agglomerated toner with tertiary latex particles.

In another aspect, the present disclosure provides a method of preparing an electrophotographic toner wherein the releasing agent dispersion includes a mixture of a paraffin-based wax and an ester-based wax; or an ester group-containing paraffin-based wax.

In another aspect, the present disclosure provides a method of preparing an electrophotographic toner wherein the amount of the ester-based wax is in the range of about 5 to about 39 weight % based on the total weight of the paraffin-based wax and the ester-based wax.

In another aspect, the present disclosure provides a method of preparing an electrophotographic toner wherein the agglomerating agent includes a Si- and Fe-containing metal salt.

In another aspect, the present disclosure provides a method of preparing an electrophotographic toner wherein the agglomerating agent includes polysilicate iron.

In another aspect, the present disclosure provides a toner supplying unit including: a) a toner tank storing toner; b) a supplying part protruding from an inner surface of the toner tank to discharge toner from the toner tank; and c) a toner-agitating member rotatably disposed inside the toner tank to agitate toner in almost the entire inner space of the toner tank including a space above a top surface of the supplying part, wherein the toner comprises any electrophotographic toner described above.

BRIEF DESCRIPTION OF THE DRAWINGS

Various features and advantages of the present disclosure will become more apparent by describing in detail several embodiments thereof with reference to the attached drawings, in which.

DETAILED DESCRIPTION OF SEVERAL EMBODIMENTS

Figure 1:
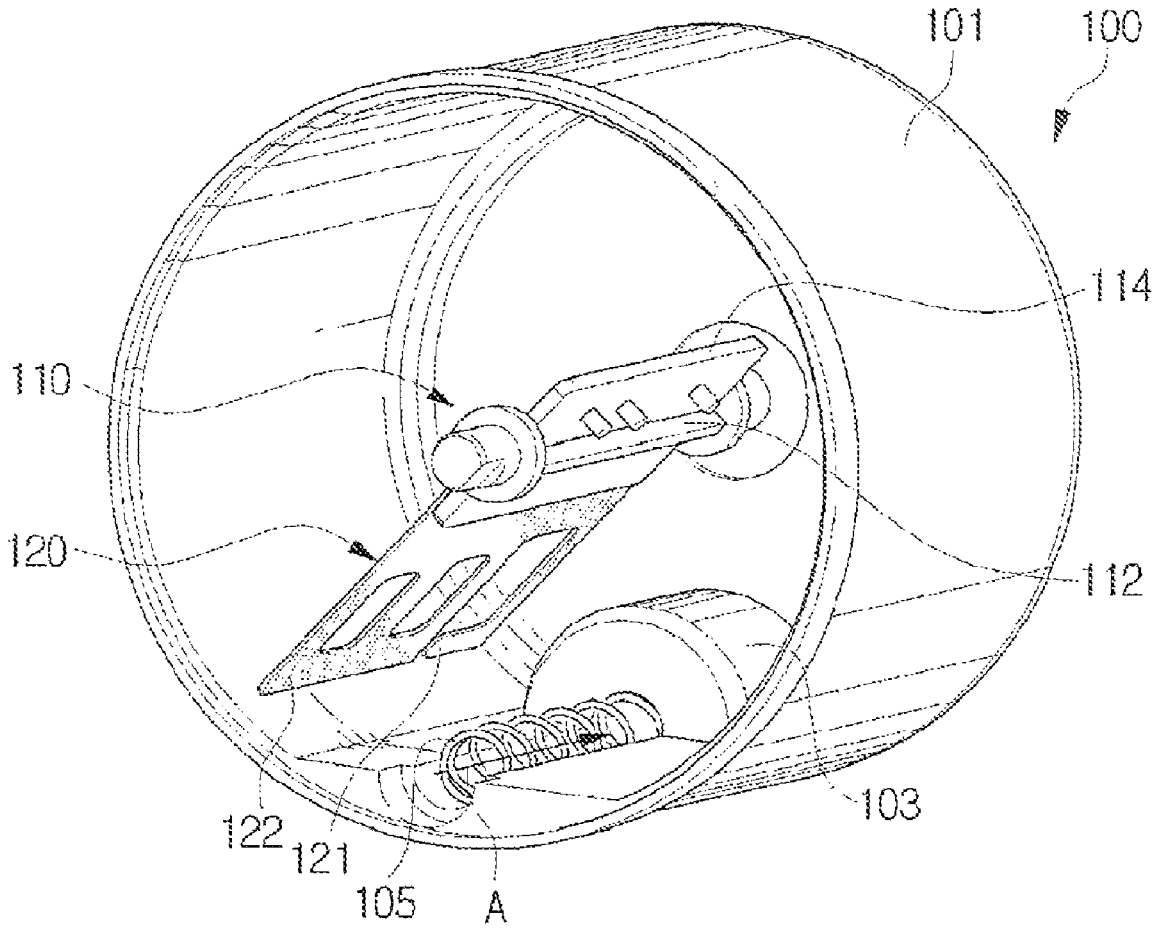
FIG. 1 is a perspective view of a toner supplying unit according to an embodiment of the present disclosure.

The present disclosure will now be described more fully with reference to several embodiments thereof and to the accompanying drawings.

According to one aspect of the present disclosure, there is provided an electrophotographic toner that comprises a latex, a colorant and a releasing agent, and that further comprises zinc (Zn), iron (Fe) and silicon (Si), wherein the [Zn]/[Fe] ratio is in the range of about $5.0\times10^{-2}$ to about 2.0, and the [Si]/[Fe] ratio is in the range of about $5\times10^{-4}$ to about $5.0\times10^{-2}$, wherein [Zn], [Fe], and [Si] denote the intensities of Zn, Fe and Si, respectively, as measured by X-ray fluorescence spectrometry.

As used herein, [Zn] corresponds to the amount of Zn contained in a Zn-containing compound that is used as a catalyst in polymerizing the latex, i.e., polyester resin, of toner. If [Zn] is too low, polymerization efficiency may be considerably low, and it may take longer to complete the reaction. On the other hand, if [Zn] is too large, the reaction rate may be too high to be controlled, and the molecular weight may be significantly increased so that it may not be able to fix the resulting toner at low temperatures. Furthermore, if [Zn] is too large, the electrical characteristics of the final toner may be adversely affected. Thus, [Zn] is to be controlled within an appropriate range.

As used herein, [Fe] corresponds to the amount of Fe contained in an agglomerating agent that is used to agglomerate the latex, the colorant and the releasing agent when toner is prepared. Thus, [Fe] may affect the agglomeration properties, the particle distribution and the particle size of agglomerated toner. In this regard, the agglomerated toner may be a precursor for preparing a final toner.

As used herein, [Si] corresponds to the amount of Si contained in an agglomerating agent that is used to prepare toner, or the amount of Si contained in silica particles that are externally added to secure the flowability of toner. Thus, [Si] may affect the agglomeration properties, the particle distribution and the particle size of agglomerated toner, as [Fe] does, and may also affect the flowability of toner.

The [Zn]/[Fe] ratio may be, for example, in the range of about $5.0\times10^{-2}$ to about 2.0, about $1.0\times10^{-1}$ to about 1.5, or about $2.0\times10^{-1}$ to about 1.0.

If the [Zn]/[Fe] ratio is less than about $5.0\times10^{-4}$, then [Zn] may be too low, and the polymerization rate may be too low to synthesize the latex. Furthermore, [Fe] is relatively increased, and thus the agglomeration properties and charging properties of toner may be adversely affected. On the other hand, if the [Zn]/[Fe] ratio is greater than about $2.0\times10^{-2}$, then [Zn] may be too high, and thus the molecular weight of the latex may be excessively increased, or the charging properties may be adversely affected. Furthermore, the relative reduction of [Fe] may result in an ineffective agglomerating process, which may in turn affect the particle distribution and/or the particle size.

The [Si]/[Fe] ratio may be, for example, in the range of about $5.0\times10^{-4}$ to about $5.0\times10^{-2}$, about $8.0\times10^{-4}$ to about $3.0\times10^{-2}$, or about $1.0\times10^{-3}$ to about $1.0\times10^{-2}$.

If the [Si]/[Fe] ratio is less than about $5.0\times10^{-4}$, then the amount of silica, which is used as an external additive, may be too low, and thus the flowability of toner may degrade. On the other hand, if the [Si]/[Fe] ratio is greater than about $5.0\times10^{-2}$, then the amount of externally added silica may be too high, possibly resulting in the contamination of the internal components of the image forming apparatus in which the toner is employed.

The electrophotographic toner may have a log G'(60) in the range of about $0.70\times10^{1}$ to about $0.90\times10^{1}$, and a $$\frac{\log G'(60)-\log G'(80)}{20}$$

value of about $1.0\times10^{-1}$ to about $2.0\times10^{-1}$.

The electrophotographic toner may have a $$\frac{\log G'(120)-\log G'(140)}{20}$$

value of about 0 to about 0.05.

As used herein, G'(60), G'(80), G'(120), and G'(140) refer to storage moduli (Pa) at 60° C., 80° C., 120° C. and 140° C., respectively, which are obtained by measuring the dynamic viscoelasticities of the toner using a circular disc-type rheometer (for example, TA ARES available from TA Instruments of New Castle, Del., U.S.A.) having two circular discs, at an angular velocity of 6.28 rad/sec, a temperature ramp rate of 1.0° C./min, and an initial strain ratio of 0.3%, wherein the strain ratio is automatically controlled during the measurement.

The dynamic viscoelasticity of toner may be dependent on the thermal properties (for example, the glass transition temperature (Tg)), the degree of cross-linking of toner, the dispersion property, compatibility, the particle size distribution, and the material used. In particular, G'(60) and G'(80), that is, viscoelasticity at a temperature of 100° C. or less is dependent on the glass transition temperature Tg and the melting temperature Tm of latex and wax, the type of agglomerating agent, or the colorant, etc. In addition, G'(120) and G'(140), that is, viscoelasticity at a temperature higher than 100° C. is highly dependent on the internal dispersion properties, the molecular weight, the degree of cross-linking, and the particle size distribution of toner, etc., rather than thermal properties of latex or wax. Thus, G'(60), G'(80), G'(120) and G'(140) may be determined according to the physical characteristics of source materials such as the latex, the colorant, the releasing agent and the agglomerating agent, etc., used to prepare the toner, and the physical characteristics of the toner prepared.

In addition, G'(60), G'(80), G'(120) and G'(140) may be used to predict fusing-related characteristics of toner. Fusing-related characteristics may include, for example, a cold offset, a minimum fusing temperature (MFT) and a fusing latitude.

The electrophotographic toner may have a log G'(60) value of, for example, in the range of about $0.70\times10^{1}$ to about $0.90\times10^{1}$, about $0.73\times10^{1}$ to about $0.87\times10^{1}$, or about $0.75\times10^{1}$ to about $0.85\times10^{1}$. If the electrophotographic toner has a log G'(60) value within the above ranges, the modulus of elasticity of the toner can be appropriately maintained at 60° C., which is an initial ramp temperature in a fusing process, and thus the toner may not be deformed in a toner transfer process. In addition, such electrophotographic toner may have excellent storage characteristics at high temperatures and developing characteristics that are not sensitive to the environmental conditions, and may exhibit acceptable durability for use in an image forming apparatus, e.g., in a printer.

In addition, the electrophotographic toner may have a $$\frac{\log G'(60)-\log G'(80)}{20}$$

value in the range of, for example, about $1.0\times10^{-1}$ to about $2.0\times10^{-1}$, about $1.2\times10^{-1}$ to about $1.8\times10^{-1}$, about $1.3\times10^{-1}$ to about $1.7\times10^{-1}$. When the electrophotographic toner has a $$\frac{\log G'(60)-\log G'(80)}{20}$$

value within the above range, the slope of the modulus of elasticity of toner is sharply reduced at near the melting temperature of the latex, and thus toner may be sufficiently melt in a fusing process, and thus fused at low temperatures within a short time (i.e., high fusing speed) with a lower amount of heat. Thus, it is relatively easy to obtain a stable image even through such a low-temperature and/or high-speed fusing process.

In addition, the electrophotographic toner may have a $$\frac{\log G'(120)-\log G'(140)}{20}$$

value of, for example, in the range of about 0 to about $5.0\times10^{-2}$, about $1.0\times10^{-2}$ to about $4.0\times10^{-2}$, or about $1.5\times10^{-2}$ to about $3.5\times10^{-2}$. When the electrophotographic toner has a $$\frac{\log G'(120)-\log G'(140)}{20}$$

value within the above ranges, the slope of the storage modulus may be gradual at high temperatures of 120-140° C., and a toner offset, which may occur when fused at a high temperature, may be minimized. Thus, it may be possible to reduce the formation of gloss spots, and to realize a high-quality, high-gloss toner capable of forming images with excellent color reproducibility.

The amounts of Si and Fe contained in the electrophotographic toner may each be in the range of, for example, about 3 to about 30,000 ppm, about 30 to about 25,000 ppm, or about 300 to 20,000 ppm. When the amounts of Si and Fe are within the above ranges, the toner may have improved charging characteristics, and may result in a reduction of contamination of the internal portions of the image forming apparatus in which such toner is used.

The latex of the electrophotographic toner may consist exclusively of a polyester resin or may include a mixture (hybrid) of a polyester resin and a polymer synthesized by polymerizing at least one polymerizable monomer.

This type of polyester resin may be obtained through the condensation reaction of a bivalent fatty acid and a bivalent alcohol. Any polyester resin may be used without limitation, provided that it is suitable for manufacturing a high-glossy electrophotographic toner that may be fused at low temperatures, that has excellent thermal storage characteristics, and that may form high-quality images with color reproducibility. For example, such a polyester resin may have a weight average molecular weight of about $1.0\times10^4$ to about $4.0\times10^4$ g/mol, and a glass transition temperature (Tg) of about 50 to 70° C. Thus, the latex of the electrophotographic toner may include at least two kinds of polyester resins having different weight average molecular weights and different glass transition temperatures.

The electrophotographic toner according to the present disclosure may have a volume average particle size in the range of about 3 to about 9 μm, about 4 to about 8 μm, or about 4.5 to about 7.5 μm. In general, the smaller toner particle size, the higher the resolution and the higher the quality of an image may be achieved. However, when transfer speed and cleansing force are taken into consideration, small toner particles may not be appropriate for all applications. Thus, the appropriate toner particle size is an important consideration.

The volume average particle diameter of toner may be measured by electrical impedance analysis.

When the volume average particle diameter of toner is greater than or equal to about 3 μm, it may be easier to clean a photoreceptor, mass-production yield can be improved, and no harmful effects on the human body are caused due to scattering. On the other hand, when the volume average particle diameter of toner is equal to or less than about 9 μm, this may lead to uniform charging, may improve fixing characteristics of toner, and may make it easier to regulate the toner layer with a doctor blade.

The electrophotographic toner may have an average circularity in the range of about 0.940 to about 0.980, about 0.945 to about 0.975, or about 0.950 to about 0.970.

The circularity of toner may be measured using a flow particle image analyzer (e.g., the FPIA-3000 particle analyzer available from SYSMEX Corporation of Kobe, Japan), and using the following equation:

$$\text{Circularity}=2\times(\pi\times\text{area})0.5/\text{circumference}$$

The circularity may be in the range of 0 to 1, and as the circularity approaches 1, toner particle shape becomes more circular.

When the electrophotographic toner has an average circularity of 0.940 or greater, an image developed on a transfer medium may have an appropriate thickness, and thus toner consumption may be reduced. In addition, voids between toner particles are not too large, and thus the image developed on the transfer medium may have a sufficient coating rate. On the other hand, when the electrophotographic toner has an average circularity of 0.980 or less, an excessive amount of toner being supplied onto a development sleeve can be prevented, making it possible to reduce the contamination of the development sleeve that may result from the non-uniform coating of toner thereon.

The toner particle distribution coefficients may include a volume average particle size distribution coefficient (GSDv) or a number average particle size distribution coefficient (GSDp), which may be measured as follows.

First, a toner particle size distribution is obtained from toner particle diameters measured using a particle sizing and counting analyzer, for example, the Multisizer™ III available from Beckman Coulter, Inc. of Fullerton, Calif., U.S.A. Toner particle diameter distribution is then divided into predetermined particle diameter ranges (channels). With respect to the respective particle diameter ranges (channels), the cumulative volume distribution of toner particles and the cumulative number distribution of toner particles are measured, wherein, in each of the cumulative volume and number distributions, the particle size in each distribution is increased in a direction from left to right. A cumulative particle diameter at 16% of the respective cumulative distributions is defined as a volume average particle diameter D16v and a number average particle diameter D16p. Likewise, a cumulative particle diameter at 50% of the respective cumulative distributions is defined as a volume average particle diameter D50v and a number average particle diameter D50p. Likewise, a cumulative particle diameter at 84% of the respective cumulative distributions is defined as a volume average particle diameter D84v and a number average particle diameter D84p.

In this regard, the GSDv and the GSDp may be obtained using the relations that the GSDv is defined as (D84v/D16v) 0.5, and the GSDp is defined as (D84p/D16p)0.5.

In this regard, the GSDv and the GSDp may be each about 1.30 or less, in the range of about 1.15 to about 1.30, or in the range of about 1.20 to about 1.25. When each of the GSDv and GSDp is within the above ranges, the electrophotographic toner may have a uniform particle diameter.

A method of preparing the electrophotographic toner, according to an embodiment of the present disclosure may include: a) mixing primary latex particles, a colorant dispersion, and a releasing agent dispersion to provide a mixed solution; b) adding an agglomerating agent to the mixed solution to provide a primary agglomerated toner; and c) coating the primary agglomerated toner with secondary latex particles to provide a secondary agglomerated toner, wherein the secondary latex particles are prepared by polymerizing at least one polymerizable monomer. The electrophotographic toner prepared according to an embodiment of the present disclosure may comprise zinc (Zn), iron (Fe) and silicon (Si), wherein the [Zn]/[Fe] ratio is in the range of about $5.0\times10^{-2}$ to about 2.0, and wherein the [Si]/[Fe] ratio is in the range of about $5.0\times10^{-4}$ to about $5.0\times10^{-2}$. [Zn], [Fe] and [Si] denote the respective intensities of Zn, Fe and Si measured by X-ray fluorescence spectrometry.

In the method according to an embodiment of the present disclosure, the primary latex particles may consist exclusively of a polyester resin or may include a mixture (hybrid) of a polyester resin and a polymer synthesized by polymerizing at least one polymerizable monomer.

This type of polyester resin may be obtained through the condensation reaction of a bivalent fatty acid and a bivalent alcohol. Any polyester resin may be used without limitation, provided that it is suitable for manufacturing a high-glossy electrophotographic toner that may be fused at low temperatures, that has excellent thermal storage characteristics, and that may form high-quality images with color reproducibility. For example, such a polyester resin may have a weight average molecular weight of about $1.0\times10^4$ to about $4.0\times10^4$ g/mol, and a glass transition temperature (Tg) of about 50 to 70° C. In addition, the primary latex particles may be prepared from at least two kinds of polyester resins having different weight average molecular weights and different glass transition temperatures.

Examples of the bivalent fatty acid include, but are not limited to, aliphatic dicarboxylic acid and aromatic dicarboxylic acid, which may be used alone or in combination.

Examples of aliphatic dicarboxylic may include, but are not limited to, oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid, 1,18-octadecanedicarboxylic acid, lower alkylesters or acid anhydrides thereof, etc.

Examples of aromatic dicarboxylic acid may include, but are not limited to, terephthalic acid, isophthalic acid, orthophthalic acid, t-butylisophthalic acid, 2,6-naphthalenedicarboxylic acid, 4,4'-biphenyldicarboxylic acid, and the like.

Examples of the bivalent alcohol may include, but are not limited to, ethyleneglycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, 1,20-eicosanediol, and the like.

Examples of a catalyst that may be used to prepare such a polyester resin include, but are not limited to, an alkali metal compound including sodium (Na), lithium (Li) or the like; an alkali earth metal compound including magnesium (Mg), calcium (Ca) or the like; a metal compound including zinc (Zn), manganese (Mn), antimony (Sb), titanium (Ti), tin (Sn), zirconium (Zr), germanium (Ge) or the like; a phosphorous acid compound; a phosphoric acid compound; an amine compound, and the like.

The primary latex particles, which are prepared using such a polyester resin, may be prepared through an inverse phase emulsification from a dispersion prepared by dispersing a polyester resin prepared through condensation polymerization, an alkali compound, and, optionally, a surfactant, in water.

In particular, the primary latex particles may be prepared through three processes, i.e., dissolution, emulsification, and desolvation. Initially, in a dissolution process, a polyester resin solution is prepared by dissolving a polyester resin in an organic solvent. Any organic solvent that can dissolve the polyester resin may be used without limitation. In the emulsification process, a basic compound and water are added to the polyester resin solution prepared in the dissolution process, and are subjected to a phase inversion emulsification. Optionally, a surfactant may further be added. Herein, the amount of the basic compound is determined based an equivalent ratio to the amount of the carboxylic acid calculated from the acid value of the polyester resin.

The resulting primary latex particles may have a volume average diameter of about 1 μm or less, in the range of about 100 to about 300 nm, or in the range of about 150 to about 250 nm.

The primary latex particles may be prepared from a mixture of the polyester resin and a polymer prepared by polymerizing at least one polymerizable monomer. In this case, examples of the at least one polymerizable monomer used herein may include, but are not limited to, at least one polymerizable monomer selected from the group consisting of styrene-based monomers such as styrene, vinyltoluene, or α-methylstyrene; acrylic acids, methacrylic acids; derivatives of (meth)acrylic acid such as methyl acrylate, ethyl acrylate, propyl acrylate, butyl acrylate, 2-ethylhexyl acrylate, dimethylaminoethyl acrylate, methyl methacrylate, ethyl methacrylate, propyl methacrylate, butyl methacrylate, 2-ethylhexyl methacrylate, dimethylaminoethyl methacrylate, acrylonirile, methacrylonirile, acrylamide, or methacrylamide; ethylenically unsaturated monoolefines such as ethylene, propylene, or butylene; halogenated vinyls such as vinyl chloride, vinylidene chloride, or vinyl fluoride; vinyl esters such as vinyl acetate or vinyl propionate; vinylethers such as vinylmethylether or vinylethylether; vinylketones such as vinylmethylketone or methylisoprophenylketone; and a nitrogen-containing vinyl compound such as 2-vinylpyridine, 4-vinylpyridine, N-vinylpyrrolidone, and the like.

For an efficient polymerization of the at least one polymerizable monomer, a polymerization initiator and a chain transfer agent may be further used.

Examples of the polymerization initiator include, but are not limited to, persulfates such as potassium persulfate or ammonium persulfate; azo compounds such as 4,4'-azobis(4-cyano valeric acid), dimethyl-2,2'-azobis(2-methylpropionate), 2,2'-azobis(2-amidinopropane)dihydrochloride, 2,2'-azobis-2-methyl-N-1,1-bis(hydroxymethyl)-2-hydroxyethylpropioamide, 2,2'-azobis(2,4-dimethylvaleronirile), 2,2'-azobisisobutyronirile, or 1,1'-azobis(1-cyclohexancarbonirile); and peroxides such as methylethylperoxide, di-t-butylperoxide, acetylperoxide, dikumylperoxide, lauroylperoxide, benzoylperoxide, t-butylperoxy-2-ethylhexanoate, di-isopropylperoxydicarbonate, or di-t-butylperoxyisophthalate, and the like. In addition, oxidation-reduction initiators prepared by combining these polymerization initiators and reductants may also be used as the polymerization initiator.

A chain transfer agent refers to a material that changes the type of a chain carrier when a chain reaction occurs, and may include a material capable of weakening the activity of a new chain to be less than the activity of existing chains. As a result of using the chain transfer agent, the degree of polymerization of polymerizable monomers may be reduced, and reaction for a novel chain may be initiated. Also, as a result of using a chain transfer agent, the molecular weight distributions of toner may be controlled.

The amount of the chain transfer agent may be in the range of about 0.1 to about 5 parts by weight, about 0.2 to about 3 parts by weight, or about 0.5 to about 2.0 parts by weight, based on 100 parts by weight of the at least one polymerizable monomer. If the amount of the chain transfer agent is within the above ranges, the molecular weight of the toner may be appropriately controlled, and thus the toner may have improved agglomeration efficiency and fixing characteristics.

Examples of the chain transfer agent may include, but are not limited to, sulfur-containing compounds such as dodecanethiol, thioglycolic acid, thioacetic acid, and mercaptoethanol; phosphorous acid compounds such as a phosphorous acid and sodium phosphorous acid; hypophosphorous acid compounds such as a hypophosphorous acid and a sodium hypophosphorous acid; and alcohols such as methyl alcohol, ethyl alcohol, isopropyl alcohol, n-butyl alcohol, and the like.

The primary latex particles may further include a charge controller. The charge controller used according to an embodiments of the present disclosure may be a negatively charged charge controller or a positively charged charge controller. Examples of the negatively charged charge controller may include, but are not limited to, organic metal complexes such as a chromium containing azo complex and a mono-azo metal complex, or chelate compounds; metal-containing salicylic acid compounds wherein the metal may be chromium, iron, or zinc; and aromatic hydroxycarboxylic acids or aromatic dicarboxylic acid. In addition, the positively charged type charge control agent may be a modified product such as nigrosine and a fatty acid metal salt thereof and an onium salt including a quaternary ammonium salt such as tributyl ammonium 1-hydroxy-4-naphthosulfonate and tetrabutylammonium tetrafluoro borate. These charge control agents may be used alone or in combination of at least two thereof. The charge controller may operate to stably support toner on a development roller with an electrostatic force. Thus, by using the charge controller, stable and high-speed charging may be ensured.

The primary latex particles obtained as described above may be mixed with the colorant dispersion and the releasing agent dispersion to prepare a mixed solution. The colorant dispersion may be obtained by uniformly dispersing a composition including a colorant, such as a black colorant, a cyan colorant, a magenta colorant, or a yellow colorant, and an emulsifier by using an ultrasonic homogenizer or a micro fluidizer.

Among colorants used to prepare the colorant dispersion, the black colorant may be carbon black or aniline black. For color toner, at least one colorant selected from the group consisting of the cyan colorant, the magenta colorant, and the yellow colorant may be further used in addition to the black colorant.

The yellow colorant may be a condensed nitrogen compound, an isoindolinone compound, an anthraquinone compound, an azo metal complex, or an alkyl imide compound. Examples of the yellow colorant include, but are not limited to, C.I. pigment yellows 12, 13, 14, 17, 62, 74, 83, 93, 94, 95, 109, 110, 111, 128, 129, 147, 168, and 180.

Examples of the magenta colorant include, but are not limited to, condensed nitrogen compounds, anthraquine compounds, quinacridone compounds, base dye lake compounds, naphthol compounds, benzo imidazole compounds, thioindigo compounds, and perylene compounds. Specifically, examples of the magenta colorant include, but are not limited to, C.I. pigment reds 2, 3, 5, 6, 7, 23, 48:2, 48:3, 48:4, 57:1, 81:1, 122, 144, 146, 166, 169, 177, 184, 185, 202, 206, 220, 221, and 254.

Examples of the cyan colorant include, but are not limited to, copper phthalocyanine compounds and derivatives thereof, anthraquinone compounds, and base dye lake compounds. Specifically, examples of the cyan colorant include, but are not limited to, C.I. pigment blues 1, 7, 15, 15:1, 15:2, 15:3, 15:4, 60, 62, and 66.

These colorants may be used alone or in combination, and may be selected in consideration of color, chromaticity, brightness, weather resistance, or dispersibility in toner.

The amount of the colorant used to prepare the colorant dispersion may be in the range of about 0.5 to about 15 parts by weight, about 1 to about 12 parts by weight, or about 2 to about 10 parts by weight, based on 100 parts by weight of toner. When the amount of the colorant is greater than or equal to 0.5 parts by weight based on 100 parts by weight of toner, a sufficient coloring effect may be obtained. When the amount of the colorant is less than or equal to about 15 parts by weight based on 100 parts by weight of toner, a sufficient electrification quantity may be obtained without a significant increase of toner manufacturing costs.

The emulsifier used to prepare the colorant dispersion may be any emulsifier known to those skilled in the art. For example, the emulsifier may be an anionic reactive emulsifier, a non-ionic reactive emulsifier, or a mixture thereof. The anionic reactive emulsifier may be, for example, HS-10 (available from Dai-Ichi Kogyo Seiyaku Co., Ltd. of Kyoto, Japan) or DOWFAX™ 2A1 (manufactured by The Dow Chemical Company of Midland, Mich., U.S.A.). The non-ionic reactive emulsifier may be RN-10 (available from Dai-Ichi Kogyo Seiyaku Co., Ltd.).

The releasing agent dispersion used in the method of preparing the electrophotographic toner may include a releasing agent, water, or an emulsifier.

The releasing agent enables toner to be fixed to a final-image receptor at a low fixing temperature and to have excellent final image durability and resistance to abrasion. Thus, characteristics of toner are very dependent on the type and amount of the releasing agent.

Examples of suitable releasing agents include, but are not limited to, polyethylene-based wax, polypropylene-based wax, silicon wax, paraffin-based wax, ester-based wax, carnauba wax, and metallocene wax. The releasing agent may have a melting point of about 50 to about 150° C. The releasing agent is physically attached to toner particles, but is not covalently bonded with toner particles, and thus enables toner to be fixed to the final-image receptor at a low temperature, and thus provides a final image that has excellent durability and resistance to abrasion.

The amount of the releasing agent may be in the range of about 1 to about 20 parts by weight, about 2 to about 16 parts by weight, or about 3 to about 12 parts by weight, based on 100 parts by weight of toner. When the amount of the releasing agent is greater than or equal to about 1 part by weight based on 100 parts by weight of toner, toner may have good low-temperature characteristics and a sufficiently wide fixing temperature range. When the amount of the releasing agent is less than or equal to about 20 parts by weight based on 100 parts by weight of toner, toner may have improved preservation characteristics and may be prepared at a lower manufacturing cost.

The releasing agent may be an ester group-containing wax. Examples of the ester group-containing wax may include a mixture of an ester-based wax and a non-ester based wax; and an ester group-containing wax prepared by adding an ester group to a non-ester based wax.

Since an ester group has high affinity with respect to the latex component of the electrophotographic toner, the wax may be uniformly distributed among toner particles, and thus may effectively function. The non-ester based wax has a releasing effect on the latex, and thus may suppress excessive plasticizing reactions, which occur when an ester-based wax is exclusively used. Therefore, toner may retain satisfactory development characteristics for a long period of time.

Examples of the ester-based wax include, but are not limited to, esters of monovalent to pentavalent alcohols and C15-C30 fatty acids such as behenic acid behenyl, steric acid stearyl, stearic acid ester of pentaeritritol, or montanic acid glyceride. Also, if an alcohol component constituting the ester is a monovalent alcohol, it may include 10 to 30 carbon atoms. If an alcohol component constituting the ester is a polyvalent alcohol, it may include 3 to 10 carbon atoms.

The non-ester based wax may be polymethylene-based wax or paraffin-based wax.

Examples of the ester group-containing wax include, but are not limited to: a mixture of a paraffin-based wax and an ester-based wax; and an ester group-containing paraffin-based wax. Examples of the ester group-containing wax may also include P-280, P-318, and P-319 (available from Chukyo Yushi Co., Ltd. of Nagoya, Japan).

If the releasing agent is a mixture of a paraffin-based wax and an ester based wax, the amount of the ester-based wax in the releasing agent may be in the range of about 5 to about 39 weight %, about 7 to about 36 weight %, or about 9 to about 33 weight %, based on the total weight of the releasing agent.

When the amount of the ester-based wax is eater than or equal to about 5 weight % based on the total weight of the releasing agent, the compatibility of the ester-based wax with the primary latex particles may be sufficiently maintained. When the amount of the ester-based wax is less than or equal to about 39 weight % based on the total weight of the releasing agent, toner may have appropriate plasticizing characteristics, and thus may retain satisfactory development characteristics for a long period of time.

Like the emulsifier used in the colorant dispersion, any emulsifier that is used in the art may be used as an emulsifier for the releasing agent. Examples of the emulsifier available for the releasing agent dispersion include, but are not limited to, an anionic reactive emulsifier, a non-ionic reactive emulsifier, and mixtures thereof. The anionic reactive emulsifier may be HS-10 (Dai-Ichi Kogyo Seiyaku Co., Ltd.) or DOWFAX™ 2A1 (The Dow Chemical Company). The non-ionic reactive emulsifier may be RN-10 (Dai-Ichi Kogyo Seiyaku Co., Ltd.).

The molecular weight, glass transition temperature (Tg) and the theological characteristics of the primary latex particles may be appropriately controlled through the method described above in such a way that toner may be fixed at low temperature.

The primary latex particles, the colorant dispersion and the releasing agent dispersion prepared as described above are mixed to obtain a mixed solution. Then, an agglomerating agent is added to the mixed solution to prepare an agglomerated toner. In particular, after the latex particles, the colorant dispersion, and the releasing agent dispersion are mixed to obtain a mixed solution, an agglomerating agent is added thereto at a pH of about 0.1 to about 4.0, and subjected to agglomeration at a temperature of about 25 to about 60° C., for example, about 35 to about 50° C., which is lower than the glass transition temperature (Tg) of the primary latex particles, and then to fusing at a temperature of about 85 to about 100° C. (a temperature that is about 30 to 50° C. higher than the Tg), thereby forming the primary agglomerated toner having a particle size of 4 to 7 μm.

Alternatively, in preparing the primary agglomerated toner, miniature toner having a particle size of 0.5 to 3 μm may first be prepared, followed by agglomeration to finally obtain the primary agglomerated toner having a particle size of 4 to 7 μm.

Once the primary agglomerated toner acting as a core has been prepared, secondary latex particles, which act as a shell, are added thereto, and the pH of the system is adjusted to a pH of 6 to 9 and left until a particle size of the mixture is maintained constant for a predetermined period of time. Then, the temperature is raised to 90 to 98° C., and the pH is lowered to 5 to 6 in order to coalesce the mixture into secondary agglomerated toner.

A Si- and Fe-containing metal salt may be used as the agglomerating agent. When such a metal salt containing Si and Fe is used, the primary agglomerated toner may have a larger particle size due to enhanced ionic strength and interparticular collisions. The Si and Fe-containing metal salt may include polysilicate iron. Examples of the Si and Fe-containing metal include, but are not limited to, PSI-025, PSI-050, PSI-085, PSI-100, PSI-200, and PSI-300, which are products manufactured by Suido Kiko Co. Table 1 shows the physical properties and compositions of PSI-025, PSI-050, PSI-085, PSI-100, PSI-200, and PSI-300.

TABLE 1

| | | Type | | | | | |
|---|---|---|---|---|---|---|---|
| | | PSI-025 | PSI-050 | PSI-085 | PSI-100 | PSI-200 | PSI-300 |
| Si/Fe mole ratio | | 0.25 | 0.5 | 0.85 | 1 | 2 | 3 |
| Main component (concentration) | Fe (wt %) | 5.0 | 3.5 | 2.5 | 2.0 | 1.0 | 0.7 |
| | SiO2 (wt %) | 1.4 | 1.9 | 2.0 | | 2.2 | |
| pH (1 w/v %) | | 2-3 | | | | | |
| Specific gravity (20° C.) | | 1.14 | 1.13 | 1.09 | 1.08 | 1.06 | 1.04 |
| Viscosity (mPa · S) | | 2.0 or greater | | | | | |
| Average molecular weight (Dalton) | | 500,000 | | | | | |
| Appearance | | transparent, yellowish brown liquid | | | | | |

The amount of the agglomerating agent may be in the range of about 0.1 to about 10 parts by weight, about 0.5 to about 8 parts by weight, or about 1 to about 6 parts by weight, based on 100 parts by weight of the primary latex particles. In this regard, when the amount of the agglomerating agent is greater than or equal to about 0.1 parts by weight, agglomeration efficiency may increase. When the amount of the agglomerating agent is less than or equal about 10 parts by weight, the charging properties of toner may not be degraded, and the particle size distribution may become more uniform.

Like the primary latex particles described above, the secondary latex particles may be prepared from a polyester resin alone or from a mixture (hybrid) of a polyester resin and a polymer prepared by polymerizing at least one polymerizable monomer.

The resulting secondary latex particles may have a volume average diameter, of about 1 μm or less, or a volume average diameter in the range of about 100 to about 300 nm. Such secondary latex particles may also include a releasing agent, which may be incorporated into the secondary latex particles in a polymerization process.

Furthermore, the secondary agglomerated toner may be additionally coated with tertiary latex particles. The tertiary latex particles may also be prepared from a polyester resin alone or a mixture (hybrid) of a polyester resin and a polymer prepared by polymerizing at least one polymerizable monomer.

By forming the shell layer with the secondary latex particles or tertiary latex particles, toner may have higher durability and excellent preservation characteristics during shipping and handling. In this regard, a polymerization inhibitor may be further added to prevent formation of new latex particles. In addition, a mixed monomer solution may be coated on latex particles in starved-feeding conditions to ensure coating quality.

The obtained secondary agglomerated toner or tertiary agglomerated toner may be filtered to separate toner particles, and toner particles are dried. Then, an external additive is added to the dried toner particles, and the amount of charge applied is controlled, thereby obtaining a final dry toner.

The external additive may include silica or $TiO_2$. The amount of the external additive may be in the range of about 1.5 to about 7 parts by weight, or about 2 to about 5 parts by weight, based on 100 parts by weight of toner to which the external additive is not added. When the amount of the external additive is greater than or equal to about 1.5 parts by weight based on 100 parts by weight of toner to which the external additive is not added, caking that occurs as toner particles adhere to each other due to an interparticular agglomeration force is prevented, and the amount of charge applied may be stable. When the amount of the external additive is less than or equal to about 7 parts by weight based on 100 parts by weight of toner to which the external additive is not added, the external additive may not contaminate a roller.

An imaging method according to an embodiment of the present disclosure may include: attaching toner to a surface of an image carrier on which an electrostatic latent image is formed so as to form a visible image; and transferring the visible image onto a transfer medium, wherein the toner may include a latex, a colorant and a releasing agent, and may further include Zn, Fe and Si, wherein the [Zn]/[Fe] ratio is in the range of about $5.0\times10^{-2}$ to about 2.0, wherein the [Si]/[Fe] ratio is in the range of about $5.0\times10^{-4}$ to about $5.0\times10^{-2}$, and wherein the [Zn], [Fe] and [Si] denote the intensities of Zn, Fe and Si, respectively, as measured by X-ray fluorescence spectrometry.

A representative electrophotographic imaging process includes a series of processes of forming images on a receptor, including charging, exposure to light, developing, transferring, fixing, cleaning, and erasing processes.

In the charging process, a surface of an image carrier is charged with negative or positive charges, whichever is desired, by a corona or a charge roller. In the exposure-to-light process, the charged surface of the image carrier is selectively discharged using a laser scanner or an array of diodes in an image-wise manner in order to form as latent image that corresponds to the final visual image to be formed on the image receptor, such as, for example, a sheet of paper. Electromagnetic radiation that may be referred to as "light radiation" include, but are not limited to, infrared radiation, visible light radiation, and ultraviolet radiation.

In the developing process, toner particles having an appropriate polarity contact the latent image on the image carrier. To this end, an electrically-biased developer having the same potential polarity as the polarity of toner particles is used. Toner particles move to the image carrier, selectively adhere to the latent image due to an electrostatic force, and thus forms a toner image on the image carrier.

In the transferring process, toner image is transferred from the image carrier to the image receptor where a final image is formed. In some cases, an intermediate transferring element may be used to aid the transfer of toner image from the image carrier to the final-image receptor.

In the fixing process, toner image on the final-image receptor is heated to soften or melt toner particles, thereby fixing toner image to the final-image receptor. Another method of fixing may involve fixing toner image to the final-image receptor under high pressure with or without the application of heat.

In the cleaning process, residual toner remaining on the image carrier is removed.

Finally, in the charge-erasing process, the charges on the image carrier are exposed to light having a specific wavelength, and thus are uniformly erased resulting in a substantially lower amount of charges on the image carrier. Therefore, the residue of the latent image may be removed, and the image carrier is made available for a further imaging cycle.

A toner supplying unit according to an embodiment of the present disclosure may include: a) a toner tank in which toner may be stored; b) a supplying part protruding from an inner surface of the toner tank to externally supply toner from the toner tank; and c) toner-agitating member rotatably disposed inside the toner tank to agitate toner in almost the entire inner space of the toner tank including a space above a top surface of the supplying part, wherein toner may be used to develop an electrostatic latent image, may include a latex, a colorant and a releasing agent, and may further includes Zn, Fe and Si, wherein the [Zn]/[Fe] ratio is in the range of about $5.0\times10^{-2}$ to about 2.0, wherein the [Si]/[Fe] ratio is in the range of about $5.0\times10^{-4}$ to about $5.0\times10^{-2}$, and wherein [Zn], [Fe], and [Si] denote the intensities of Zn, Fe and Si, respectively, as measured by X-ray fluorescence spectrometry.

FIG. 1 is a view of a toner supplying unit 100 according to an embodiment of the present disclosure.

Toner supplying unit 100 according to an embodiment may include a toner tank 101, a supplying part 103, a toner-conveying member 105 and a toner-agitating member 110.

The toner tank 101 is configured to store therein a predetermined amount of toner, and may have a substantially hollow cylindrical shape.

The supplying part 103 may be disposed on an inner bottom surface of the toner tank 101, and may be configured to externally discharges toner contained in the toner tank 101. For example, the supplying part 103 may protrude from the bottom of the toner tank 101 to have a pillar shape with a semi-circular cross section. The supplying part 103 may include a toner outlet (not shown) in an outer side thereof, through which toner outlet the toner may be discharged.

Toner-conveying member 105 may be disposed at a side of the supplying part 103 on the inner bottom surface of the toner tank 101. Toner-conveying member 105 may have, for example, a coil spring shape. An end of toner-conveying member 105 may extend inside the supplying part 103 so that toner in the toner tank 101 is conveyed into the supplying part 103 as toner-conveying member 105 rotates. Toner conveyed by toner-conveying member 105 may be externally discharged through toner outlet of the supplying part 101

Toner-agitating member 110 is rotatably disposed inside the toner tank 101 and forces toner in the toner tank 101 to move in a radial direction. For example, when toner-agitating member 110 rotates at a middle of the toner tank 101, toner in the toner tank 101 is agitated to prevent toner from solidifying. As a result, toner moves down to the bottom of the toner tank 101 due to gravity. Toner-agitating member 110 includes a rotation shaft 112 and a toner-agitating film 120. The rotation shaft 112 is rotatably disposed at the middle of the toner tank 101, and may have a driving gear (not shown) that may be coaxially coupled with an end of the rotation shaft 112 protruding from a side of the toner tank 101. Therefore, the rotation of the driving gear causes the rotation shaft 112 to rotate. Also, the rotation shaft 112 may have a support plate 114 to help fix toner-agitating film 120 to the rotation shaft 112. The support plate 114 may be formed to be substantially symmetric about the rotation shaft 112. Toner-agitating film 120 has a width corresponding to the inner length of the toner tank 101. Furthermore, the toner-agitating film 120 may be elastically deformable in consideration of the shape of a projection inside the toner tank 101, i.e., the supply part 103. The toner-agitating film 120 may include a first agitating part 121 and a second agitating part 122 formed by cutting an end of the toner-agitating film 120 toward the rotation shaft 112 by a predetermined length.

An imaging apparatus according to an embodiment of the present disclosure may include: an image carrier; an imaging unit forming an electrostatic image on the surface of the image carrier; a unit containing toner; a toner supplying unit supplying toner to the surface of the image carrier to develop the electrostatic image into a toner image; and a toner transfer unit transferring the toner image formed on the surface of the image carrier to a transfer medium, wherein the toner used to develop the electrostatic latent image may include a latex, a colorant and a releasing agent, and may further include Zn, Fe and Si, wherein the [Zn]/[Fe] ratio is in the range of about $5.0\times10^{-2}$ to about 2.0, wherein the [Si]/[Fe] ratio is in the range of about $5.0\times10^{-4}$ to about $5.0\times10^{-2}$, and wherein [Zn], [Fe] and [Si] denote the intensities of Zn, Fe and Si, respectively, as measured by X-ray fluorescence spectrometry.

Figure 2:
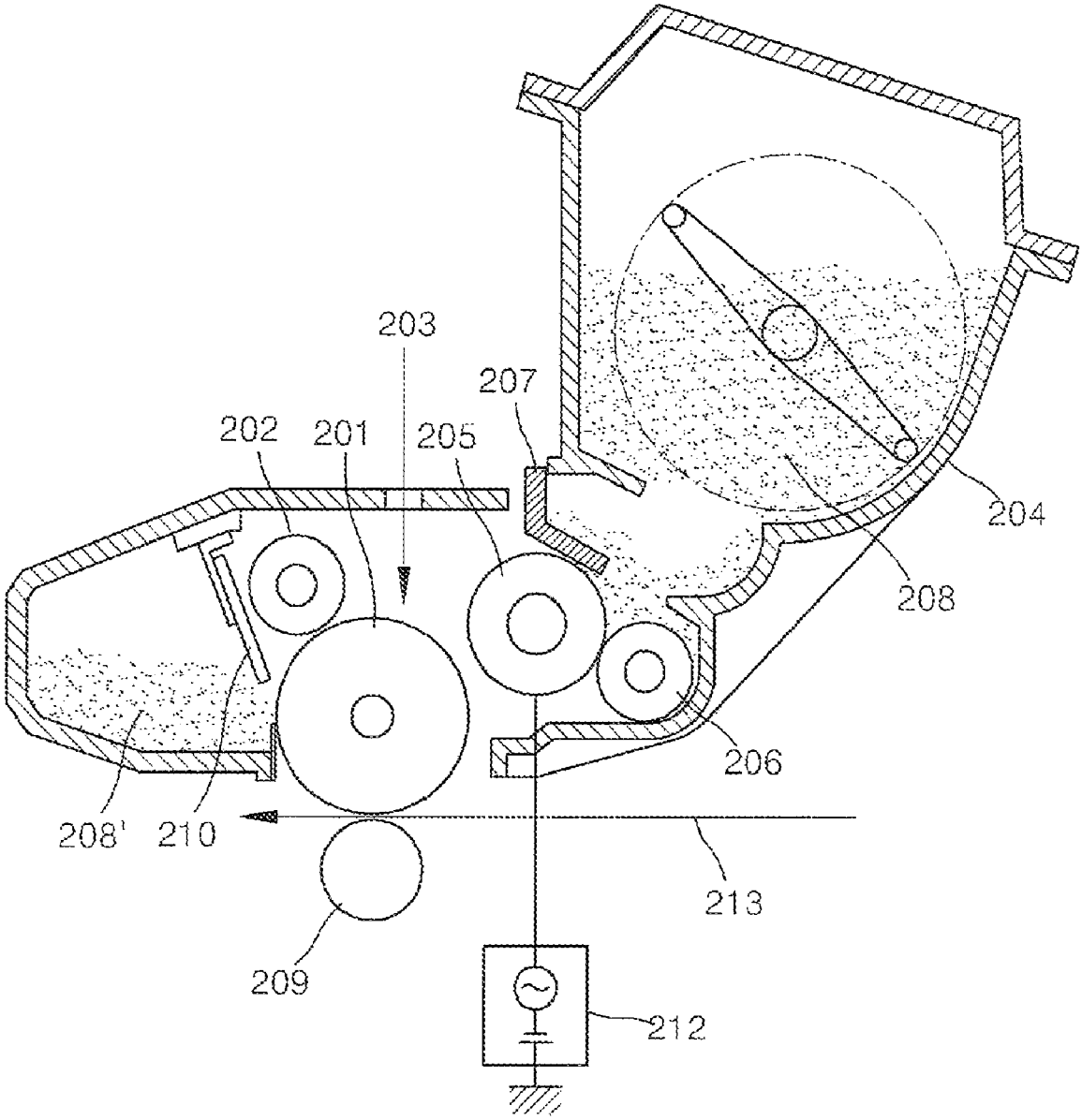
FIG. 2 is a schematic view of a toner imaging apparatus according to an embodiment of the present disclosure.

FIG. 2 is a schematic view of a non-contact development type imaging apparatus utilizing toner prepared according to an embodiment of the present disclosure.

A non-magnetic one-component developer, i.e., toner 208, in a developing device 204 is supplied to a developing roller 205 by a supply roller 206 formed of an elastic material, such as polyurethane foam or sponge. The toner 208 supplied onto the developing roller 205 reaches a contact portion between a developer-regulating blade 207 and the developing roller 205 as the developing roller 205 rotates. The developer-regulating blade 207 may be formed of an elastic material, such as metal or rubber. When toner 208 passes through the contact portion between the developer-regulating blade 207 and the developing roller 205, the amount of toner 208 may be regulated to be a thin layer of a uniform thickness, and may also be sufficiently charged. Toner 208 which has been formed into a thin layer is transferred to a development region of a photoreceptor 201 where a latent image on the surface of the photoreceptor 201 is developed with the toner supplied by the developing roller 205, wherein the photoreceptor 201 is an example of an image carrier. As previously described, the latent image is formed by scanning light 203 onto the photoreceptor 201.

The developing roller 205 is arranged to face the photoreceptor 201 while being spaced apart from the photoreceptor 201 by a predetermined distance. The developing roller 205 and the photoreceptor 201 may rotate in opposite directions with respect to each other. For example, the developing roller 205 may rotate in a counterclockwise direction while the photoreceptor 201 may rotate in a clockwise direction.

According to an embodiment, toner 208, which has been transferred to the development region of the photoreceptor 201, develops the latent image formed on the photoreceptor 201 into a toner image using an electrostatic three generated due to the potential difference between a direct current (DC)-biased alternating current (AC) voltage applied to the developing roller 205 and the latent potential of the photoreceptor 201 charged by a charging unit 202.

Toner image, which has been developed on the photoreceptor 201, reaches a transfer unit 209 as the photoreceptor 201 rotates. Toner image, which has been developed on the photoreceptor 201, is transferred to a print medium 213 when the print medium 213 passes between the photoreceptor 201 and the transfer unit 209 by the transfer unit 209 having a roller shape and to which a high voltage having a polarity opposite to toner 208 is applied.

Toner image transferred to the print medium 213 passes through a high-temperature, high-pressure fusing device (not shown), and thus is fused to the print medium 213, thereby resulting in a fixed image. The non-developed, residual developer 208' on the developing roller 205 is collected by the supply roller 206 contacting the developing roller 205 whereas the non-developed, residual developer 208' on the photoreceptor 201 is collected by a cleaning blade 210. The processes described above may be repeated for formation of subsequent images.

EXAMPLES

The embodiments of the present disclosure will be described in more detail with reference to several specific examples below, which examples are provided for illustrative purposes only, and which are not intended to limit the scope of the present disclosure.

Scanning electron microscopic (SEM) images of toners prepared according to the following examples were obtained to identify shapes of toners. The circularity of toners was obtained using an FPIA-3000 (SYSMEX Corp.), and using the equation below:

$$\text{Circularity}=2\times(\pi\times\text{area})0.5/\text{circumference}$$

The circularity may be in the range of 0 to 1, and as the circularity approaches 1, toner particle shape becomes more circular.

The physical properties of polyester resins used in the following preparation examples are shown in Table 2.

TABLE 2

| | Polyester resin | | |
|---|---|---|---|
| | P-1 | P-2 | P-3 |
| Weight average molecular weight (g/mol) | 14,000 | 15,000 | 30,000 |
| Number average molecular weight (g/mol) | 10,000 | 10,000 | 17,000 |
| Acid value | 5 | 5 | 8 |
| Glass transition temperature (° C.) | 62 | — | 63 |
| Melting temperature (° C.) | — | 70 | — |

Example 1

Preparation of Latex 1

500 g of polyester resin P-1, 400 g of methylethylketone (MEK), and 100 g of isopropylalcohol (IPA) were placed in a 3 L double-jacketed reactor, and were dissolved at 30° C. while stirring with a mechanical anchor-type stirrer to obtain a polyester resin solution, 10% of aqueous ammonia solution was slowly added to the polyester resin solution while stirring, and 1,500 g of water was further added at a rate of 50 g/min with continuously stirring to prepare an emulsion. The solvent was removed from the emulsion by distillation at reduced pressure to obtain latex 1 having a 40% solid content.

Example 2

Preparation of Latex 2

Latex 2 having a 40% solid content was prepared in the same manner as in Preparation Example 1, except that polyester resin P-2 was used instead of polyester resin P-1.

Example 3

Preparation of Latex 3

Latex 3 having a 40% solid content was prepared in the same manner as in Preparation Example 1, except that polyester resin P-3 was used instead of polyester resin P-1.

Example 4

Preparation of Colorant Dispersion 10 g in total of an anionic reactive emulsifier (HS-10; Dai-Ichi Kogyo Seiyaku Co., Ltd.) and a nonionic reactive emulsifier (RN-10; Dai-Ichi Kogyo Seiyaku Co., Ltd.) in ratios shown in Table 3 were added to a milling bath, together with 60 g of a colorant (cyan), 400 g of glass beads each having a diameter of about 0.8 to about 1 mm were added thereto, and then milling was performed thereon at room temperature to prepare dispersions. A homogenizer used in this experiment was an ultrasonic homogenizer or a micro fluidizer.

TABLE 3

| color | colorant | HS-10:RN-10 (wt %) |
|---|---|---|
| cyan | PB 15:4 | 100:0 |
| | | 80:20 |
| | | 70:30 |

Example 5

Preparation of Releasing Agent Dispersion

P-420 (Chukyo Yushi Co., Ltd.) was used as a releasing agent dispersion, as shown in Table 4.

TABLE 4

| | |
|---|---|
| Wax | P-420 |
| Paraffin wax content | 25-35% |
| Synthetic ester wax content | 5-10% |
| Viscosity (mPa · s/25° C.) | 13 |
| melting point (DSC) | 89° C. |

Example 6

Agglomeration and Preparation of Toner 316 g of deionized water, 250 g of latex 1 having a 40% solid content prepared in Preparation Example 1, and 57 g of latex 2 having a 40% solid content prepared in Preparation Example 2, wherein latex 1 and latex 2 function as primary latex particles constituting cores, were placed in a 1L reactor, and were stirred at 350 rpm. 35 g of 19.5% cyan colorant dispersion (HS-10 100%) prepared in Preparation Example 4 and 28 g of 35% releasing agent dispersion P-420 (Chukyo Yushi Co., Ltd) prepared in Preparation Example 5 were added thereto to obtain a mixed solution. Then, 30 g (0.3 mol) of a nitric acid, and 15 g of 12% PSI-100 (available from Suido Kiko Co. Ltd. of Tokyo, Japan) as an agglomerating agent were added to the mixed solution, stirred using a homogenizer at a rate of 11,000 rpm for 6 minutes, and then heated stepwise up to 45° C., thereby obtaining miniature toner having a volume average diameter of about 0.3 to about 3 μm. The miniature toner was further agglomerated for 1 hour to obtain primary agglomerated toner having a volume average diameter of about 4 to about 5 μm.

Then, 150 g of latex 3 having a 40% solid content prepared in Preparation Example 3 was added as secondary latex particles. 1 mol of NaOH was added to adjust pH to 7 when the volume average particle diameter of toner reached about 5 to about 6 μm. When the volume average particle diameter was maintained constant for 10 minutes, the temperature was increased to 96° C. at a rate of 0.5° C./min. When the temperature reached 96° C., 0.3 mol of nitric acid was added thereto to adjust the pH to 5.7. Then, the resultant was fused for 4 to 5 hours to obtain secondary agglomerated toner having a volume average diameter of about 5.5 to about 6.5 μm and a potato shape. Then, the agglomerated reaction solution was cooled to a temperature lower than Tg, and then was filtered to isolate toner particles, followed by drying.

0.5 parts by weight of NX-90 (available from Nippon Aerosil Co., Ltd. of Osaka, Japan), 1.0 part by weight of RX-200 (Nippon Aerosil Co., Ltd.), and 0.5 parts by weight of SW-100 (available from Titan Kogyo Kabushiki Kaisha of Ube, Japan) were externally added to 100 parts by weight of the dried toner particles and stirred using a mixer (KM-LS2K, available from DAEWHA TECH Co., Ltd. of Yong-In, South Korea) at a rate of 8,000 rpm for 4 minutes. The resultant toner had a volume average diameter in the range of 5.5 to 6.0 μm, a GSDp of 1.2, and a GSDv of 1.23. The average circularity of toner was 0.972.

Example 7

Preparation of Toner with a Volume Average Diameter of about 5.5 to about 6.0 μm Toner having a volume average diameter of about 5.5 to about 6.0 μm was prepared in the same manner as in Example 6, except that 5 g of 12% PSI-100 (Suido Kiko Co. Ltd.) was used as an agglomerating agent. Toner had a GSDp of 1.28 and a GSDv of 1.25. The average circularity of toner was 0.970.

Example 8

Preparation of Toner with a Volume Average Diameter of about 5.5 to about 6.0 μm Toner having a volume average diameter of about 5.5 to about 6.0 μm was prepared in the same manner as in Example 6, except that 20 g of 12% PSI-100 (Suido Kiko Co. Ltd.) was used as an agglomerating agent. Toner had a GSDp of 1.23 and a GSDv of 1.3. The average circularity of toner was 0.978.

Example 9

Comparative Example 1

Toner having a volume average diameter of about 5.5 to about 6.0 μm was prepared in the same manner as in Example 6, except that 1 g of 12% PSI-100 (Suido Kiko Co. Ltd.) was used as an agglomerating agent. Toner had a GSDp of 1.4 and a GSDv of 1.35. The average circularity of toner was 0.997.

Example 10

Comparative Example 2

Toner having a volume average diameter of about 5.5 to about 6.0 μm was prepared in the same manner as in Example 6, except that 30 g of 12% PSI-100 (Suido Kiko Co. Ltd.) was used as an agglomerating agent. Toner had a GSDp of 1.31 and a GSDv of 1.5. The average circularity of toner was 0.959.

Example 11

Comparative Example 3

Toner having a volume average diameter of about 5.5 to about 6.0 μm was prepared in the same manner as in Example 6, except that 30 g of MgCl2 and 10 g of NaCl were used as agglomerating agents. Toner had a GSDp of 1.82 and a GSDv of 1.55. The average circularity of toner was 0.895.

Example 12

Comparative Example 4

Toner having a volume average diameter of about 5.5 to about 6.0 μm was prepared in the same manner as in Example 6, except that 30 g of polyaluminum chloride (PAC, available from Sigma-Aldrich Co. of St. Louis, Mo., U.S.A.) was used as an agglomerating agent. Toner had a GSDp of 1.25 and a GSDv of 1.22. The average circularity of toner was 0.973.

Evaluation of Toner

<Particle Shape>

The circularity of toner may be measured using a flow particle image analyzer (FPIA-3000 available from SYSMEX Corp.), and using the following equation:

$$\text{Circularity}=2\times(\pi\times\text{area})0.5/\text{circumference}$$

The circularity may be in the range of 0 to 1, and as the circularity approaches 1, toner particle shape becomes more circular.

Particle shape may be represented using the circularity of particles less or equal to 3 μm in the particle size distribution measured using the FPIA-3000.

Evaluation Criteria

◎: 0.976~0.966

○: 0.976~0.985, or 0.963~0.966

Δ: 0.985~0.990 or 0.960~0.963

X: 0.99 or greater, or 0.960 or less

<Particle Size Distribution>

Measurement Equipment: Multisizer™ III (Beckman Coulter, Inc.)

Electrolyte: ISOTON II

Aperture Tube: 100 μm

Number of particles: 30,000

Evaluation Criteria

◎: 1.25 or less

○: 1.25~1.30

X: greater than 1.30

<X-Ray Fluorescence Measurement>

An X-ray fluorescence measurement of each of the samples was performed using an energy dispersive X-ray spectrometer (EDX-720 available from SHIMADZU Corp. of Kyoto, Japan). An X-ray tube voltage was 50 kV, and the amounts of samples that were molded were 3 g±0.01 g. For each sample, [Zn]/[Fe] and [Si]/[Fe] were calculated using intensities (unit: cps/uA) measured using quantitative results obtained by the X-ray fluorescence measurement.

<Presence of Aluminum>

As aluminum (Al) is an environmentally restricted metal, the presence if Al was detected using X-ray fluorescence measurement.

Evaluation Criteria

○: Al detected.

X: no Al detected.

<Fixing Characteristics Evaluation>

Measurement device: Belt-type fixing device (Color Laser 660 available from Samsung Electronics Co., Ltd. of Seoul, South Korea)

Unfixed image for testing: 100% pattern

Test temperature: 150° C.

Test paper: 60 g paper sheet (X-9 available from Boise, Inc. of Boise, Id., U.S.A.), and 90 g paper sheet (Xerox Exclusive available from Xerox Corp. of Norwalk, Conn., U.S.A.)

Fixing speed: 160 mm/sec

Fixing time: 0.08 sec

This experiment was performed under the conditions described above, and then the fixability of the fixed image was evaluated in the following manner.

The optical density (OD) of the fixed image was measured, and then a 3M 810 tape was attached to the fixed image. A weight of 500 g was reciprocated thereon five times, and then the tape used was removed. Then, the OD of the fixed image was measured again.

$$\text{Fixability}(\%)=\{(\text{OD after peeling off the tape})/(\text{OD before peeling off the tape})\}\times100$$

Evaluation Criteria

◎: 90% or greater

○: 80~90%

Δ: 70~80%

X: 70% or less

<Gloss Evaluation>

This experiment was performed using a glossmeter (micro-TRI-gloss available from BYK-Gardner of Columbia, Md., U.S.A.) at a temperature of 160° C. at which the fixing device was used.

Measurement angle: 60°

Measurement pattern: 100% pattern

Evaluation Criteria

◎: 6% or greater

○: 4~6%

Δ: 2~4%

X: 2% or less

TABLE 5

| | Type of agglomerating agent | XRF data [Zn]/[Fe] | XRF data Si | Particle shape | Particle size distribution | Al included or not (environmentally restricted metal) | Gloss | Fixing characteristics |
|---|---|---|---|---|---|---|---|---|
| Example 1 | PSI-100 | 0.36 | 4.1 × 10-3 | ◎ | ◎ | X | ◎ | ◎ |
| Example 2 | PSI-100 | 1.0 | 4.5 × 10-2 | ○ | ○ | X | ◎ | ◎ |
| Example 3 | PSI-100 | 0.21 | 6.0 × 10-4 | ◎ | ○ | X | ◎ | ◎ |

TABLE 5-continued

| | Type of agglomerating agent | XRF data [Zn]/[Fe] | XRF data Si | Particle shape | Particle size distribution | Al included or not (environmentally restricted metal) | Gloss | Fixing characteristics |
|---|---|---|---|---|---|---|---|---|
| Example 9: Comparative Example 1 | PSI-100 | 2.5 | 7.0 × 10-2 | Δ | X | X | ◎ | ○ |
| Example 10: Comparative Example 2 | PSI-100 | 0.003 | 4.0 × 10-4 | Δ | X | X | Δ | Δ |
| Example 11: Comparative Example 3 | $MgCl_2$/NaCl | — | — | X | X | X | ○ | Δ |
| Example 12: Comparative Example 4 | PAC | — | — | ◎ | ○ | ○ | X | Δ |

Referring to Table 5, the electrophotographic toners of Example 1 through 3, wherein $5.0\times10^{-4}\leqq[Zn]/[Fe]\leqq5.0\times10^{-1}$ and $5.0\times10^{-4}\leqq[Si]/[Fe]\leqq5.0\times10^{-2}$, where [Zn], [Fe], and [Si] denote the intensities of Zn, Fe and Si, respectively, as measured by X-ray fluorescence spectrometry, have excellent gloss, fixing characteristics and particle size distribution, compared to toners of Examples 9-12 (Comparative Examples 1 through 4).

As described above, according to the present disclosure, electrophotographic toner having small particle diameter, narrow particle size distribution, excellent low-temperature fixing characteristics and thermal storage characteristics, color-reproducible high image quality, and high gloss may be prepared.

While the present disclosure has been particularly shown and described with reference to several embodiments thereof, it will be understood by those of ordinary skill in the art that various changes in form and details may be made therein without departing from the spirit and scope of the present disclosure as defined by the following claims and their equivalents.

What is claimed is:

1. An electrophotographic toner that includes a latex, a colorant and a releasing agent, wherein the electrophotographic toner further comprises zinc (Zn), iron (Fe) and silicon (Si), wherein the [Zn]/[Fe] ratio is in the range of about $5.0\times10^{-2}$ to about 2.0, wherein the [Si]/[Fe] ratio is in the range of about $5.0\times10^{-4}$ to about $5.0\times10^{-2}$, wherein [Zn], [Fe] and [Si] denote the intensities of Zn, Fe and Si, respectively, as measured by an X-ray fluorescence spectrometry, and wherein the electrophotographic toner has a log G'(60) in the range of about $0.70\times10^{1}$ to about $0.90\times10^{1}$, and a $$\frac{\log G'(60)-\log G'(80)}{20}$$

value of about $1.0\times10^{-1}$ to about $2.0\times10^{-1}$, and wherein G'(60) and G'(80) denote the storage moduli (Pa) of the electrophotographic toner at temperatures of 60° C. and 80° C. respectively, when the dynamic viscoelasticity of the electrophotographic toner is measured at an angular velocity of 6.28 rad/sec, a temperature ramp rate of 2.0° C./min, and an initial strain ratio of 0.3%.

2. The electrophotographic toner of claim 1, wherein the electrophotographic toner has a $$\frac{\log G'(120)-\log G'(140)}{20}$$

value of about 0 to about $5.0\times10^{-2}$, and wherein G'(120) and G'(140) denote the storage moduli (Pa) of the electrophotographic toner at temperatures of 120° C. and 140° C. respectively, when the dynamic viscoelasticity of the electrophotographic toner is measured at an angular velocity of 6.28 rad/sec, a temperature ramp rate of 1.0° C./min, and an initial strain ratio of 0.3%.

3. The electrophotographic toner of claim 1, wherein the amount of each of Si and Fe is in the range of about 3 to about 30,000 ppm.

4. The electrophotographic toner of claim 1, wherein the latex comprises at least two different polyester resins.

5. The electrophotographic toner of claim 1, wherein an average particle diameter of the electrophotographic toner is in the range of about 3 to about 9 μm.

6. The electrophotographic toner of claim 1, wherein an average circularity of the electrophotographic toner is in the range of about 0.940 to about 0.980.

7. The electrophotographic toner of claim 1, wherein the volume average particle size distribution coefficient (GSDv) of the electrophotographic toner is about 1.3 or less, and the number average particle size distribution coefficient (GSDp) of the electrophotographic toner is about 1.3 or less.

* * * * *